US005190280A

United States Patent [19]

Gray et al.

[11] Patent Number: 5,190,280

[45] Date of Patent: Mar. 2, 1993

[54] SHEET SIZE INDICATION MEANS FOR A UNIVERSAL SHEET FEED CASSETTE

[75] Inventors: Thomas W. Gray; Christopher S. Garcia, both of Rochester, N.Y.

[73] Assignee: Eastman Kodak Company, Rochester, N.Y.

[21] Appl. No.: 740,228

[22] Filed: Aug. 5, 1991

[51] Int. Cl.[5] ..... B65H 1/00

[52] U.S. Cl. ..... 271/171; 271/255; 242/84.8

[58] Field of Search ..... 271/160, 171, 223, 253, 271/255, 265; 242/84.8, 107

[56] References Cited

U.S. PATENT DOCUMENTS

| | | | |
|---|---|---|---|
| 3,463,416 | 8/1969 | Quenot | 242/84.8 |
| 4,190.246 | 2/1979 | Sasuga | 271/145 |
| 4,277,165 | 7/1981 | Wada et al. | 355/55 |
| 4,440,487 | 8/1984 | Miura | 355/14 R |
| 4,499,341 | 2/1985 | Boyd | 242/107 X |
| 4,579,333 | 4/1986 | Aoki | 271/162 |
| 4,685,793 | 8/1987 | Sawada et al. | 355/3 SH |
| 4,696,563 | 9/1987 | Shibusawa | 355/8 |
| 4,697,803 | 10/1987 | Kan et al. | 271/171 X |
| 4,707,111 | 11/1987 | Inuzuka et al. | 355/8 |
| 4,780,740 | 10/1988 | Fukae | 355/3 SH |
| 4,796,056 | 1/1989 | Ito | 355/14 SH |
| 4,804,997 | 2/1989 | Mizude et al. | 355/14 SH |
| 4,855,787 | 8/1989 | Hashimoto et al. | 355/311 |
| 4,862,220 | 8/1989 | Ito | 355/311 |

FOREIGN PATENT DOCUMENTS

| | | | |
|---|---|---|---|
| 7841 | 1/1981 | Japan | 271/171 |
| 172332 | 9/1984 | Japan | 271/171 |
| 201735 | 9/1987 | Japan | 271/171 |
| 225221 | 9/1990 | Japan | 271/171 |

*Primary Examiner*—Robert P. Olszewski
*Assistant Examiner*—Boris Milef
*Attorney, Agent, or Firm*—J. Gary Mohr

[57] ABSTRACT

A universal sheet feed cassette for use in an apparatus using various commercially standard and commercially nonstandard sheet sizes during its operation. The universal sheet feed cassette discloses the size of the sheets contained within the cassette by a tracking of the movement of the cassette's movable guide. The apparatus in which the cassette is loaded can then detect the sheet size contained within the cassette. Once the sheet size is detected, the apparatus adjusts its operating parameters to adapt to the size sheet contained within the cassette.

7 Claims, 4 Drawing Sheets

SHEET SIZE INDICATION MEANS FOR A UNIVERSAL SHEET FEED CASSETTE

BACKGROUND OF THE INVENTION

The most common use of sheet feed cassettes is in the printing, recording and copying fields. The sheet feed cassette houses a plurality of recording sheets having a predetermined size, with the sheets being set in a predetermined position within the cassette. The cassette is adapted for insertion into a copying, recording or printing apparatus. Such apparatus employ a system in which the recording sheets are fed seriatim from the cassette. This, however, requires the availability of different cassettes for each recording sheet size. Examples of this are disclosed in U.S. Pat. Nos. 4,277,165; 4,440,487 and 4,696,563.

Multiple cassettes housings of the three or more housing variety are provided in a number of copying, recording or printing apparatus, as disclosed in U.S. Pat. Nos. 4,804,997 and 4,862,220, to accommodate cassettes containing recording sheets of different sizes. In such an apparatus each cassette housing has associated with it preset operating parameters to accommodate the particular size of recording sheet for that housing. As an example, when recording on a large size recording sheet, such as A3, a greater optical scanning distance is required of the copying apparatus. Therefore, the housing that accommodates a cassette containing A3 recording sheets has a preset scanning distance to accommodate copying on A3 size sheets. This allows for precise scanning of the documents to be copied and results in a very efficient use of the apparatus' optical scanning system. It also increases the number of reproductions per unit time since the apparatus, on sensing the size of the sheet to be recorded upon, can adjust its scan so it matches precisely the travel distance for the size sheet to be recorded upon. With the scan matching precisely the size of the recording sheet, underscan of the image to be copied is avoided, since the scan will be identical to the size recording sheet to be recorded upon. Overscan is also avoided, since the scan will never be greater than the size of the sheet to be recorded upon. Recording efficiency is thereby improved. In addition, when scanning is based upon recording sheet size, it is possible to have auto-magnification, auto-paper select, edge erase and interframe erase, but these patents do not disclose a total solution, since they require multiple cassettes and the need for a copying apparatus having multiple housing slots.

To avoid the need for multiple size cassettes, a cassette capable of housing recording sheets of different sizes was developed and put into practical use. Such a cassette is called a universal cassette and consists of a cassette body capable of housing recording sheets up to a specified maximum size. The cassette has a movable rear guide adapted to adjust to the location of the rear edge (the edge that is furthest away from the edge initially inserted into the copying, printing or recording apparatus) and one or two movable side guides adapted to adjust to the location of the side edges of the recording sheet. The front edge, and perhaps one side edge, are maintained in position by fixed walls of the cassette.

While a universal cassette avoids the need to have multiple size cassettes, it doesn't resolve the problem of less than ideal operational parameters when commercially nonstandard sheet sizes are used. An illustration of this is a universal cassette used in a conventional copying, recording or printing apparatus, such as one having only one cassette housing. The optical scanning maybe adjusted, as shown in U.S. Pat. Nos. 4,579,333 and 4,780,740. However, these patents only address adjusting operational parameters when commercially standard size sheets are contained in the cassette. They do not have the ability to recognize other than commercially standard size sheets. This is inefficient, since the optical scanning travel distance is only set for commercially standard size sheets, irrespective of the size recording sheets used. Under these circumstances, the reproduction rates for certain sheet sizes, notwithstanding the actual size of the recording sheet, measured on a per unit time basis would be equal. In other words, when recording with sheets of commercially nonstandard size, a larger than necessary scanning distance is required. If a smaller scan distance were used, there would be unused space on the recording sheet. This results in a decrease in reproduction efficiency or inefficient use of the recording sheet, since there is either overscan or space on the recording sheet that is not utilized, even when using a universal cassette.

SUMMARY OF THE INVENTION

A universal sheet feeding cassette is provided with at least one movable guide member so as to contact the trailing edge of a recording sheet to be loaded into the cassette. The cassette has a disclosure means comprised of means secured to said movable guide, with the secured means cooperating with a sheet indicator means to disclose the size of the sheets loaded in the cassette.

An object of the present invention is, therefore, to eliminate the drawbacks of the prior art, such as cassettes of multiple size, inefficient use of the internal components of the apparatus due to over- or underscan, and the need to manually reprogram parameters of the apparatus whenever recording sheet size changes, by providing disclosure means that can accurately disclose recording sheets of commercially nonstandard size.

Another object is to assure, when recording on sheets of commercially nonstandard size, the scanning distance of the apparatus may be set to efficiently scan for recording on said sheets. This prevents useless scanning of areas that cannot be reproduced on the size sheets contained within the cassette and the resultant decrease in apparatus efficiency that such inefficient scanning causes.

The above and other objects, as well as advantages of the invention, will become apparent from the following description of the preferred embodiment as described in conjunction with the accompanying drawings.

DESCRIPTION OF THE PREFERRED EMBODIMENT OF THE INVENTION

Figure 1:
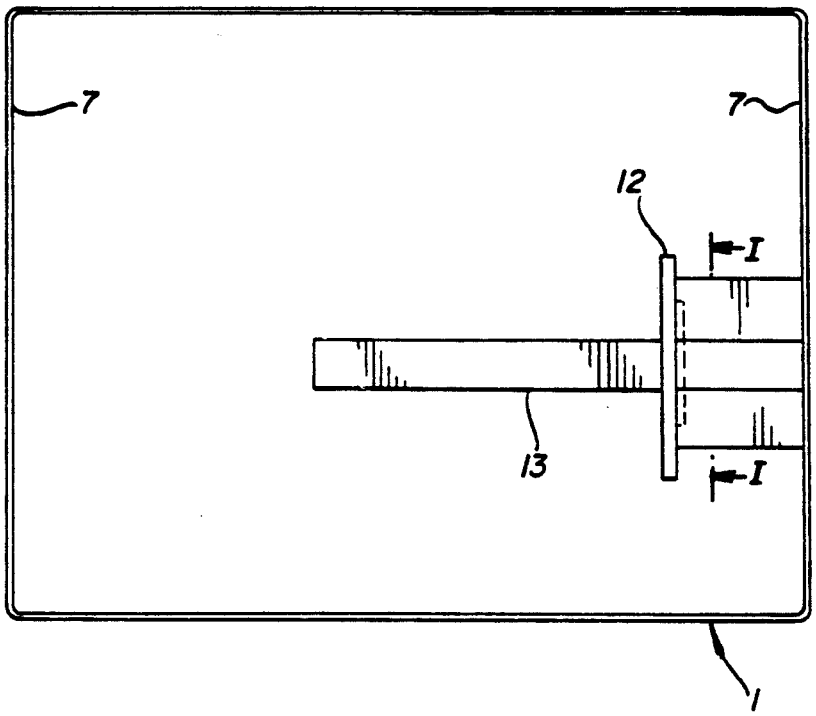
FIG. 1 PRIOR ART
FIG. 1 is a top view of a prior art universal cassette.

In describing the preferred embodiment of the instant invention, reference is made to the drawings, wherein like numerals indicate like parts and structural features in the various views, diagrams and drawings. For the sake of discussion but not limitation, the preferred embodiment of the present invention will be described in relation to a photocopying apparatus. In FIG. 1, a prior art cassette 1 for a photocopying apparatus has an inner bottom surface 3 on which various commercially standard, and commercially nonstandard, sized recording sheets 5, see prior art cassette shown in FIG. 2, can be accommodated. Recording sheets 5 rest with one of their longitudinal sides, and one of their transverse sides, against the inner side of cassette wall 7 of cassette 1. The other longitudinal and transverse sides rest against movable guide members 12.

A general description of a prior art guide member 12 for the longitudinal guiding direction is described and shown, it being understood that guide member 12 for the longitudinal guiding direction is equivalent to guide member 12 for the transverse guiding direction. While guide members, such as guide member 12, are known in the art, a brief description is deemed necessary to understand the operation of a universal cassette and how the present invention is used in conjunction with said cassette.

Figure 2:
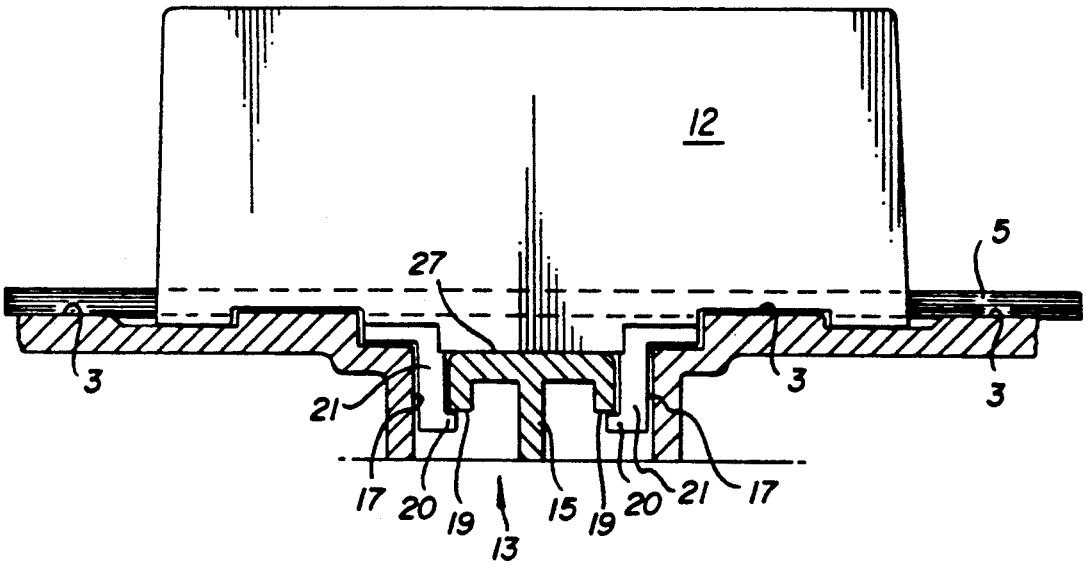
FIG. 2 PRIOR ART
FIG. 2 is a sectional view of the side of a prior art universal cassette taken along line I—I of FIG. 1.

To control the movement of movable guide member 12 along sheet support surface 3, a slideway 13 is disposed on the bottom surface of cassette 1, see prior art FIGS. 1 and 2. Shown in prior art FIG. 2 is a central T-beam 15 which extends in the longitudinal guiding direction and forms an integral unit with the sheet support surface 3 of cassette 1. T-beam 15 is separated from the adjacent areas of the sheet support surface 3 of cassette 1 by opening slots 17 extending in the longitudinal guiding direction.

Movable guide member 12 is positioned on slideway 13 with guide elements 20 in engagement with holding surfaces member 19 upon which guide elements 20 ride when movable guide member 12 is moved.

The upper side of T-beam 15, which is opposite to the holding surfaces 19, forms a clamping surface 27 cooperating with a clamping means, not shown, of movable guide member 12, to secure movable guide member 12 by frictional engagement along slideway 13.

While the above describes one type of prior art movable guide member, others are known in the art and can be used in conjunction with the disclosure means of the invention hereinafter described.

Figure 4:
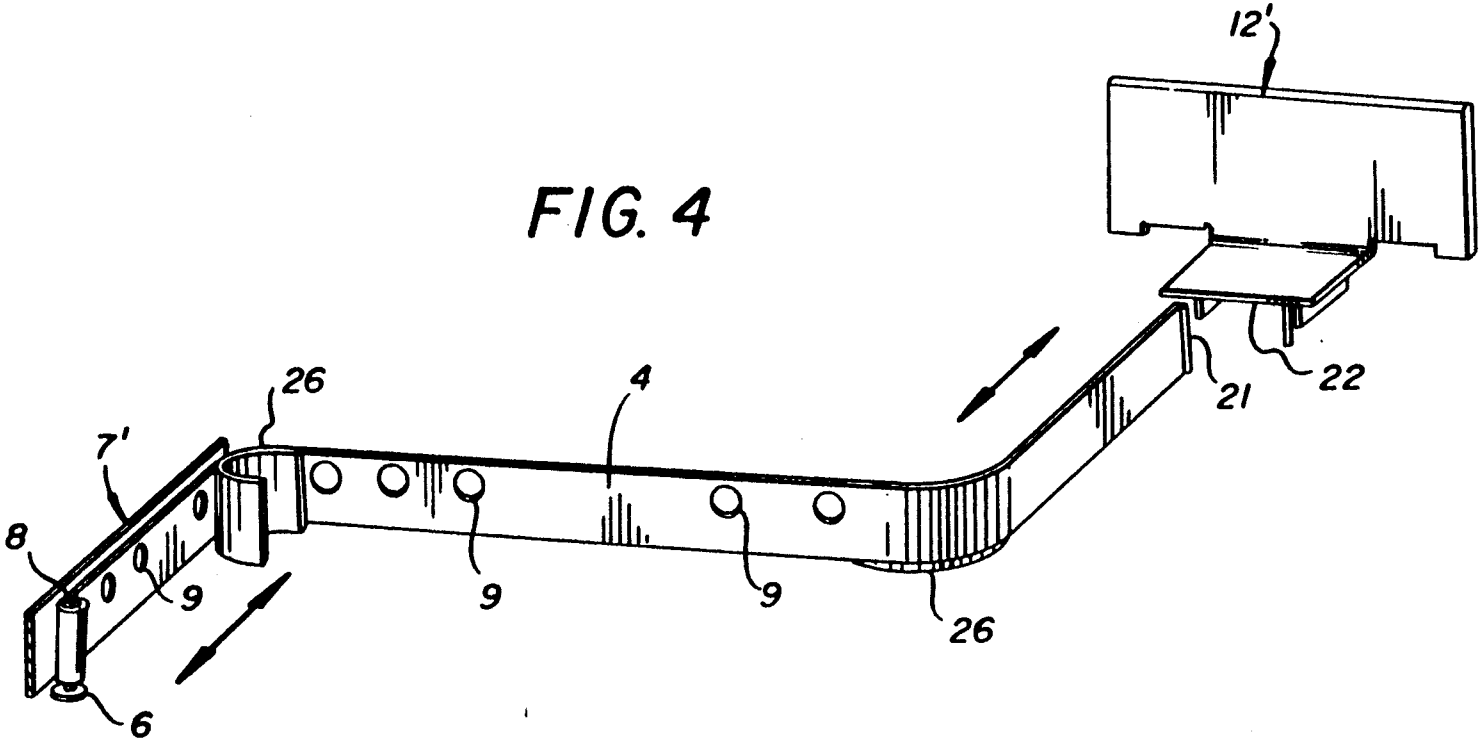
FIG. 4 is a perspective view of the ribbon disclosure means in accordance with the present invention.
Figure 3:
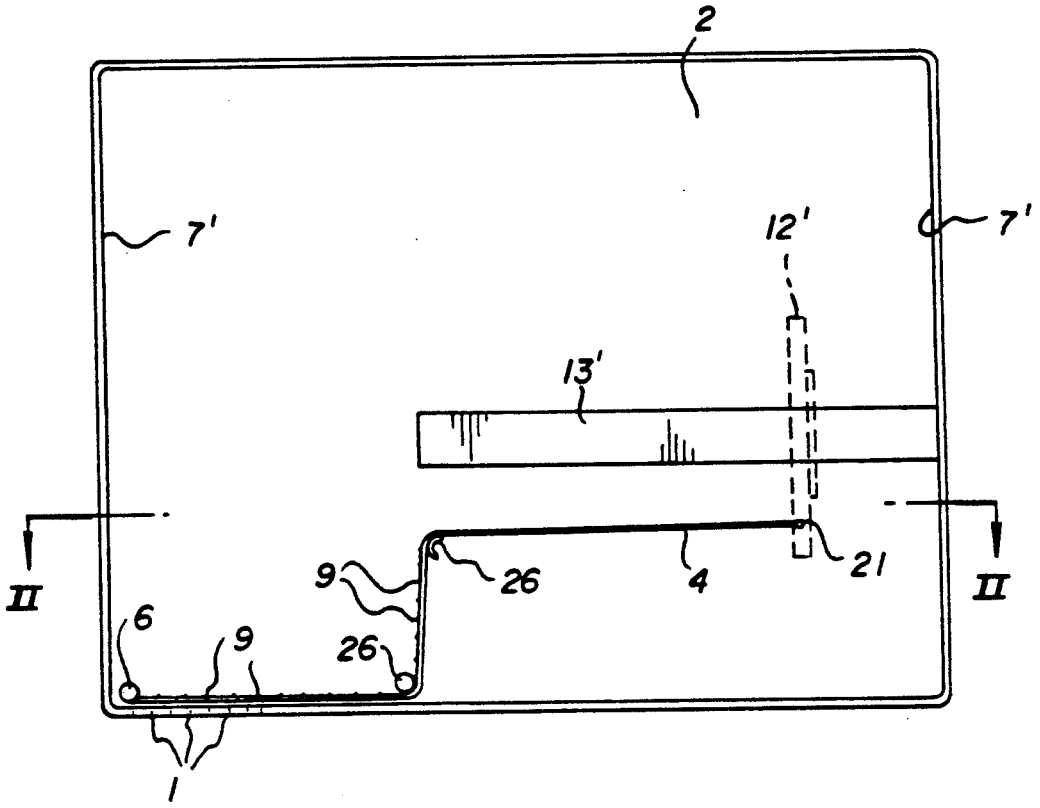
FIG. 3 is a bottom view of the universal cassette in accordance with the present invention.
Figure 7:
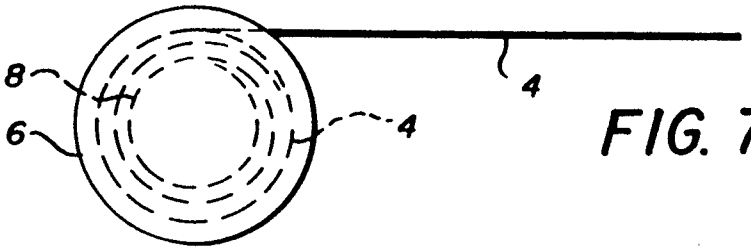
FIG. 7 is a top view of the supply and take-up spool in accordance with the present invention.
Figure 8:
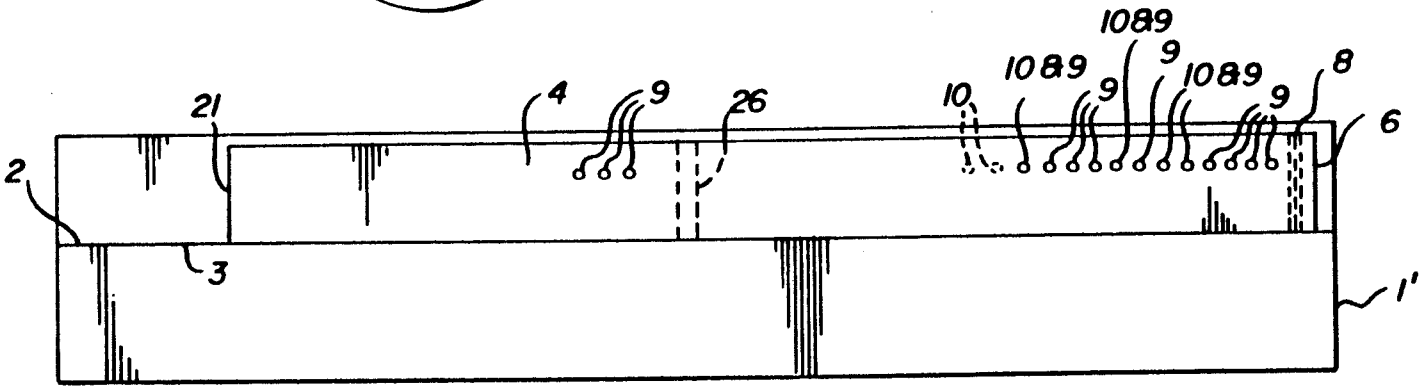
FIG. 8 is a sectional view of the side of the universal cassette taken along line II—II of FIG. 3 in accordance with the present invention.

On the bottom surface 2 of cassette 1', see FIG. 3, is located sheet size indicating ribbon 4. Ribbon 4 has one end securely mounted to movable guide member 12' and the other end mounted to supply and take-up spool 6, see FIG. 4. Supply and take-up spool 6, see FIG. 7, is of sufficient size to accommodate a sufficient amount of ribbon 4, to allow ribbon 4 to track movable guide member 12' from its location adjacent to one of the lateral cassette walls 7' to its location furthest away from that lateral cassette wall 7', as movable guide member 12' travels longitudinally to accommodate the size of recording sheets 5 contained within cassette 1'. Ribbon 4 is preferably a baked 0.0022 inch thick, with a 0.0015 to 0.0030 inch thick range being acceptable, carbon-impregnated opaque polyester ribbon with self-recoiling properties. Ribbon 4 is in constant tension between movable guide member 12' and supply and take-up spool 6. Supply and take-up spool 6 is constrained by mechanical means, know in the art, against freely rotating about shaft 8, which is securely mounted to bottom surface 2 of cassette 1', when not acted upon by the movement of movable guide member 12'. Ribbon 4 has holes 9 which either align or misalign, see FIG. 8, with one or more of holes 10 of cassette wall 7' as movable guide member 12' is positioned to retain one of the plurality of sheet sizes capable of being housed in cassette 1'.

In operation, after guide member 12' is positioned to accommodate the size recording sheet 5 contained within cassette 1', cassette 1' is inserted into a housing of a copying apparatus. Once inserted, a light is transmitted from the sending side of a detecting assembly, not shown, located within the copying apparatus and adjacent to holes 10 of cassette wall 7'. Depending upon the position of holes 9 of ribbon 4, light transmitted by the sending side of the detecting assembly is transmitted through one or more of the holes 10 in cassette wall 7', and holes 9 in ribbon 4, and received by the receiver side of the detecting assembly. Because of the multiplicity of combinations of hole alignment and misalignment between holes 9 in ribbon 4 and holes 10 in cassette wall 7', with each combination representing a different size sheet, the size of recording sheet 5, commercially standard or commercially nonstandard, within cassette 1' can be accurately determined. Once determined, the copying apparatus can adjust its operational parameters to optimum operation.

An alternative approach to using opaque ribbon 4 with holes 9 is to use clear or transparent ribbon 4 with the positions where holes 9 would have been, replaced by ink, paint or other light-blocking means.

In operation, when one moves movable guide member 12' longitudinally toward the rear edge (the edge that is furthest away from the edge initially inserted into the copying apparatus) of cassette wall 7' to accommodate larger recording sheets 5, ribbon 4 is caused to move about guide 26 and unravel from supply and take-up spool 6. Moving movable guide member 12' longitudinally away from the rear edge of cassette wall 7' to accommodate smaller recording sheets 5 in cassette 1' causes ribbon 4 to move about guide 26 and rewind on supply and take-up spool 6. The light-blocking means 9 of ribbon 4 are spaced such that each combination of alignment and misalignment of light blocking means 9 with holes 10 in cassette wall 7' correspond to one of the multiplicity of sheet, commercially standard and commercially nonstandard, sizes capable of being loaded into cassette 1'. The detecting assembly of the apparatus, by sensing the light transmitted through holes 10, accurately determines the size of recording sheets 5 in cassette 1'. Once the size of sheet 5 is established, the apparatus adjust its operating parameters to accommodate that size sheet.

Figure 5:
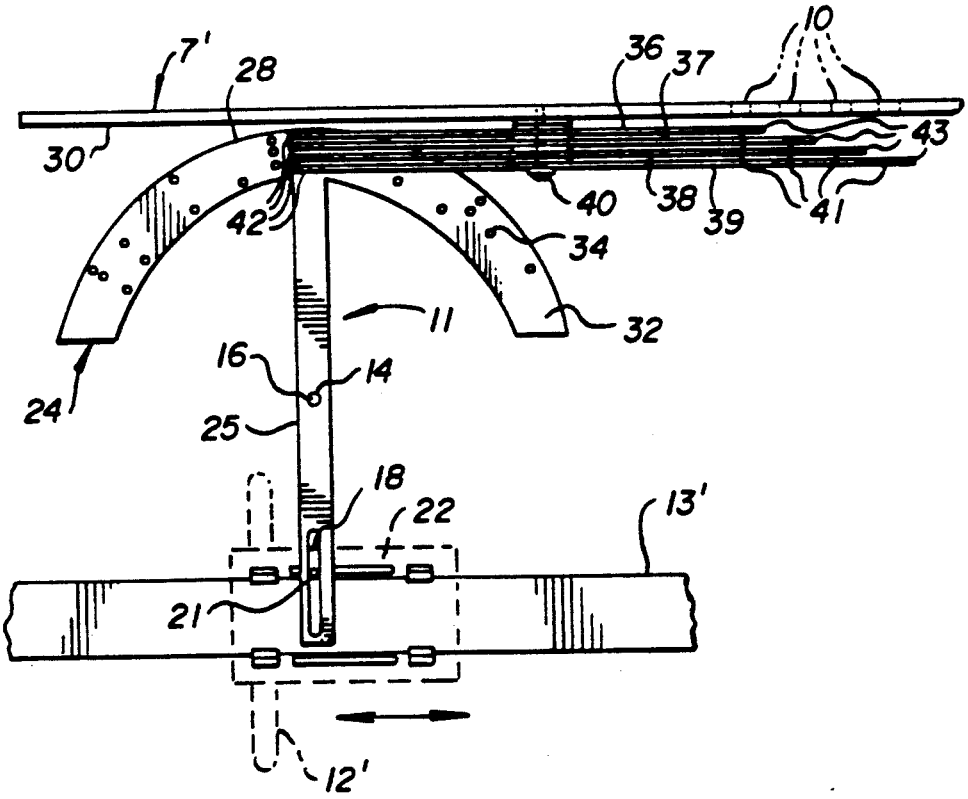
FIG. 5 is the bottom view of the optional lever-arc disclosure means in accordance with the present invention.
Figure 6:
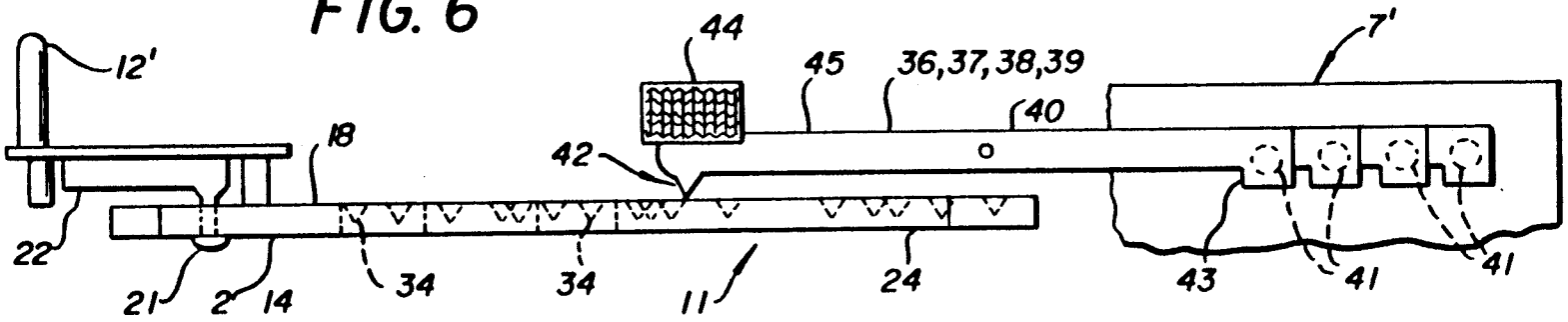
FIG. 6 is a side view of the optional lever-arc disclosure means in accordance with the present invention.

An alternative approach to using transparent or opaque ribbon 4 is to use an acr-lever system 11, shown in FIGS. 5 and 6. The lever portion 25 of arc-lever 11 is pivotal at point 14 about shaft 16 located on the bottom surface 2 of cassette 1'. One end of lever 25 has a slot 18 which is in slidable contact with a shaft 21 attached to the bottom surface 22 of movable guide member 12'. The other end of lever 25 contains the arc portion 24 of arc-lever 11. The edge surface 28 of arc 24 rides adjacent the inside surface 30 of cassette wall 7'. Lever portion 25 pivots about shaft 16 in response to movement of movable guide member 12'. The movement of movable guide member 12', to accommodate the various sizes of recording sheets 5 that may be contained in cassette 1', causes slot 18 to slide on shaft 21. Arc 24 has on its lower surface 32 various recesses 34. In mating contact with arc 24, its lower surface 32 and recesses 34 are indicator levers 36, 37, 38 and 39. Said indicator levers 36, 37, 38 and 39 pivot about shaft 40, which is secured to the inside surface 30 of cassette wall 7'. At one end of each indicator lever 36, 37, 38 or 39 is a light blocking portion 43. Light blocking portions 43 move in and out of alignment with holes 10 located in cassette wall 7', as indicator levers 36, 37, 38 and 39 pivot about shaft 40 in response to each sensing tip 42 of each indicator lever 36, 37, 38 or 39, moving into and out of mating contact with recesses 34 of arc 24. While indicator levers 36, 37, 38 and 39 are of a transparent or clear material, the light blocking portions 43 are nontransparent. The transparency of indicator levers 36, 37, 38 and 39 prevents indicator levers 36, 37, 38 and 39 from blocking any light meant to be transmitted in the absence of light blocking portions 43. Acting upon indicator levers 36, 37, 38 and 39 is spring 44 biased between the bottom surface 2 of cassette 1' and the top surface 45 of indicator levers 36, 37, 38 and 39. Spring 44 keeps the sensing tip 42 of each indicator lever 36, 37, 38 and 39 in contact with either the recesses 34 or the lower surface 32 of arc 24.

In operation, as the movable guide member 12' is moved to accommodate various sizes, commercially standard and commercially nonstandard, of recording sheets 5 in cassette 1', the edge surface 28 of arc 24 is caused to ride adjacent wall surface 30 of cassette wall 7', due to the sliding of slot 18 about shaft 21. As arc 24 moves, the sensing tips 42 of indicator levers 36, 37, 38 and 39 move into and out of recesses 34 causing light blocking portions 43 of indicator levers 36, 37, 38 and 39 to either align or misalign with holes 10 of cassette 1'. Depending on the alignment or misalignment and the light received by the receiving side from the sending side of the detecting assembly, the apparatus, in which cassette 1' is inserted, detects the size of recording sheets 5 in cassette 1' and adjust its operating parameters to operate in the mode best suited for the size recording sheets 5 contained in cassette 1'.

While the present invention has been described with reference to the particular structure disclosed herein, it is not intended that it be limited to the specific details, and this application is intended to cover such modifications or changes as may come within the purposes or scope of the claims forming a part hereof.

We claim:

1. A universal sheet feeding cassette with at least one movable guide member adapted to contact a trailing edge of a recording sheet loaded in the cassette, the cassette comprising:

a cassette wall having a series of holes for indicating the recording sheet size loaded in the cassette;

a supply and take up spool within the cassette;

a sheet disclosure means, having as a first portion a self-recoiling ribbon having a series of holes and as a second portion the series of holes in the cassette wall, for disclosing a recording sheet size loaded in the cassette;

a first section of the self-recoiling ribbon is attached directly to the movable guide member and a second section of the self-recoiling ribbon is attached directly to the supply and take up spool.

2. A universal sheet feeding cassette of claim 1 wherein the self-recoiling ribbon wraps about itself and the spool.

3. The cassette of claim 1 wherein the ribbon is opaque.

4. The cassette according to claim 3 wherein the opaque ribbon is a baked carbon-impregnated polyester material.

5. The cassette according to claim 4 wherein the opaque ribbon is in constant tension with the movable guide member.

6. The cassette according to claim 1 wherein the ribbon is transparent and has a series of nontransparent zones.

7. A universal sheet feeding cassette with at least one movable guide means so as to contact a trailing edge of a recording sheet loaded in the cassette, the cassette comprising:

a cassette wall having a series of holes for indicating the recording sheet size loaded in the cassette;

a supply and take up spool within the cassette;

sheet disclosure means, having as a first portion a self-recoiling ribbon having a series of holes and as a second portion the series of holes in the cassette wall, for disclosing the recording sheet size in the cassette, the sheet disclosure means cooperating with a detecting means, located within an apparatus for housing the cassette, for detecting recording sheet size loaded within the cassette, a first section of the self-recoiling ribbon is secured directly to the movable guide member and a second section of the self-recoiling ribbon is secured directly to the supply and take up spool and said first portion cooperates with said second portion for indicating the recording sheet size loaded in the cassette.

* * * * *